US011581635B2

(12) United States Patent
Sudo et al.

(10) Patent No.: US 11,581,635 B2
(45) Date of Patent: Feb. 14, 2023

(54) ANTENNA MODULE

(71) Applicant: Murata Manufacturing Co., Ltd., Kyoto (JP)

(72) Inventors: Kaoru Sudo, Kyoto (JP); Yoshiki Yamada, Kyoto (JP); Kengo Onaka, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/158,505

(22) Filed: Jan. 26, 2021

(65) Prior Publication Data

US 2021/0151874 A1 May 20, 2021

Related U.S. Application Data

(63) Continuation of application No. PCT/JP2019/029675, filed on Jul. 29, 2019.

(30) Foreign Application Priority Data

Aug. 6, 2018 (JP) ..... JP2018-147575

(51) Int. Cl.
*H01Q 19/02* (2006.01)
*H01Q 21/08* (2006.01)
(Continued)

(52) U.S. Cl.
CPC ..... *H01Q 1/523* (2013.01); *H01Q 19/021* (2013.01); *H01Q 21/0075* (2013.01); *H01Q 21/08* (2013.01); *H01Q 25/001* (2013.01)

(58) Field of Classification Search
CPC ..... H01Q 1/2283; H01Q 1/242; H01Q 1/243; H01Q 1/38; H01Q 1/52; H01Q 1/521;
(Continued)

(56) References Cited

U.S. PATENT DOCUMENTS 6,448,930 B1 * 9/2002 Judd ..... H01Q 1/007 343/700 MS
7,265,719 B1 * 9/2007 Moosbrugger ..... H01Q 21/065 343/893
(Continued)

FOREIGN PATENT DOCUMENTS

JP H06291544 A 10/1994
JP 2008113187 A 5/2008
(Continued)

OTHER PUBLICATIONS

International Search Report issued in Application No. PCT/JP2019/029675, dated Aug. 27, 2019.
(Continued)

*Primary Examiner* — Jason Crawford
(74) *Attorney, Agent, or Firm* — Pearne & Gordon LLP

(57) ABSTRACT

An antenna module includes a first antenna element disposed at a first dielectric substrate, a second antenna element disposed at a second dielectric substrate, a joint connecting the first dielectric substrate and the second dielectric substrate, and a power supply line. The second dielectric substrate is different from the first dielectric substrate with respect to the normal direction. The power supply line extends from the first dielectric substrate via the joint to the second antenna element and is configured to communicate a radio-frequency signal to the second antenna element. At least a part of the power supply line at the joint is formed in a direction crossing the polarization plane of radio waves radiated by the first antenna element and the second antenna element.

18 Claims, 11 Drawing Sheets

(51) Int. Cl.
*H01Q 25/00* (2006.01)
*H01Q 1/52* (2006.01)
*H01Q 21/00* (2006.01)

(58) Field of Classification Search
CPC ..... H01Q 1/523; H01Q 19/02; H01Q 19/021; H01Q 21/0075; H01Q 21/06; H01Q 21/065; H01Q 21/08; H01Q 25/00; H01Q 25/01
See application file for complete search history.

(56) References Cited

U.S. PATENT DOCUMENTS 7,289,069 B2 * 10/2007 Ranta ..... H01Q 9/30 343/702
11,075,462 B2 * 7/2021 Suzuki ..... H01Q 21/24
2002/0122006 A1 * 9/2002 Crawford ..... H01Q 9/0407 343/702
2005/0264448 A1 * 12/2005 Cox ..... H01Q 1/085 343/700 MS
2009/0143038 A1 * 6/2009 Saito ..... H01Q 13/106 455/272
2013/0050056 A1 * 2/2013 Lee ..... H01Q 3/30 343/893
2018/0062263 A1 * 3/2018 Ueda ..... H01Q 21/06
2018/0188838 A1 * 7/2018 An ..... H01Q 7/00
2019/0089052 A1 * 3/2019 Yong ..... H01Q 9/0407
2019/0103653 A1 * 4/2019 Jeong ..... H01Q 1/2283
2019/0229399 A1 * 7/2019 Wang ..... H01Q 1/38
2019/0229404 A1 * 7/2019 Xia ..... H01Q 21/22
2019/0229405 A1 * 7/2019 Xia ..... H01Q 21/08
2019/0372229 A1 * 12/2019 Dalmia ..... H01Q 1/085
2020/0119453 A1 * 4/2020 Takayama ..... H01Q 1/243
2020/0169007 A1 * 5/2020 Song ..... H01Q 21/293
2020/0381843 A1 * 12/2020 Murata ..... H01Q 1/243
2021/0083380 A1 * 3/2021 Takayama ..... H01Q 9/0428
2021/0126366 A1 * 4/2021 Sudo ..... H01Q 5/28
2021/0135364 A1 * 5/2021 Yamada ..... H01Q 9/045
2021/0151874 A1 * 5/2021 Sudo ..... H01Q 21/065
2021/0242569 A1 * 8/2021 Fujii ..... H05K 3/361
2021/0320429 A1 * 10/2021 Takayama ..... H01Q 1/243

FOREIGN PATENT DOCUMENTS

JP 2010177983 A 8/2010
JP 5925894 B2 5/2016
JP 2017195433 A 10/2017

OTHER PUBLICATIONS

Written Opinion issued in Application No. PCT/JP2019/029675, dated Aug. 27, 2019.

* cited by examiner

FIG. 11
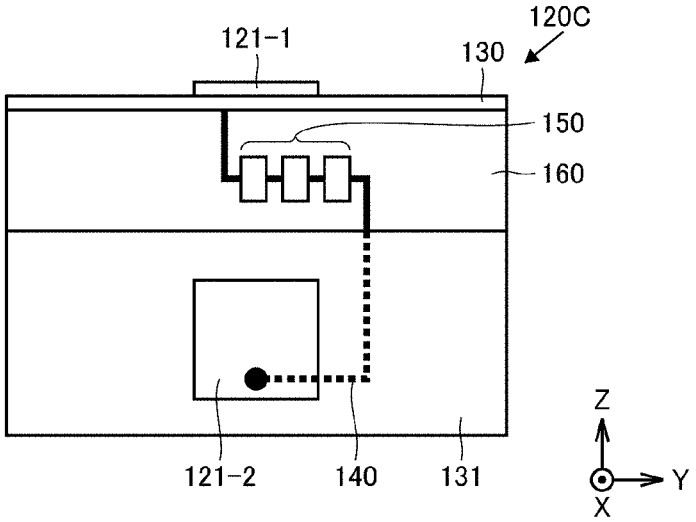
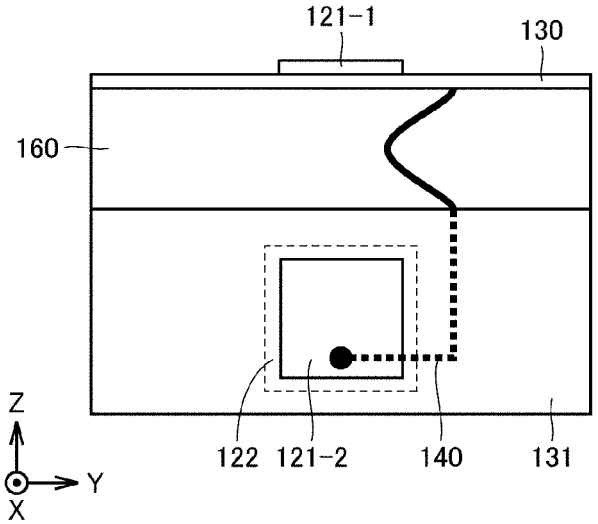
FIG. 12A
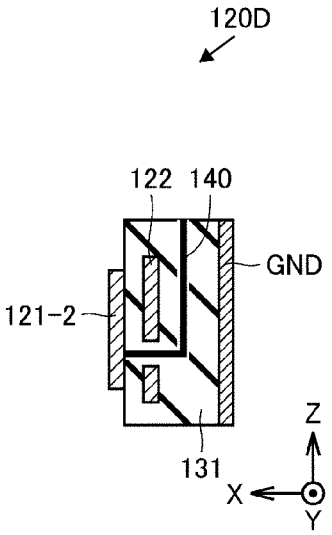
FIG. 12B

ANTENNA MODULE

CROSS REFERENCE TO RELATED APPLICATION

This is a continuation of International Application No. PCT/JP2019/029675 filed on Jul. 29, 2019 which claims priority from Japanese Patent Application No. 2018-147575 filed on Aug. 6, 2018. The contents of these applications are incorporated herein by reference in their entireties.

BACKGROUND

Technical Field

The present disclosure relates to antenna modules. In particular, the present disclosure relates to a technology of reducing the effect of radiation from a power supply line of an antenna element in an antenna capable of radiating radio waves in two different directions.

For wireless communication devices, known antenna systems can radiate radio waves in different spatial directions.

Japanese Patent No. 5925894 (Patent Document 1) discloses a wireless device having a configuration including a first set of antenna elements (patch antennas) formed on a first plane and a second set of antenna elements (patch antennas) formed on a second plane pointing in a spatial direction different from the spatial direction of the first plane.

With the configuration of Japanese Patent No. 5925894 (Patent Document 1), it is possible to radiate radio waves in two different directions of the direction of the antenna beam formed by the first set of antenna elements and the direction of the antenna beam formed by the second set of antenna elements, and as a result, a wider coverage area can be achieved.

Patent Document 1: Japanese Patent No. 5925894

BRIEF SUMMARY

In Japanese Patent No. 5925894 (Patent Document 1), a radio-frequency signal inputted from an RF chip is transmitted to each antenna element through the conductive interconnection (power supply lines) formed on a glass substrate on which the antenna elements are arranged. In this case, the power supply line also functions as an antenna, so that radio waves can also be radiated from the power supply line. When the polarization direction of radio waves radiated from the power supply line and the polarization direction of radio waves radiated from the antenna element are identical to each other, the radio waves radiated from the power supply line can be a cause of noise for the radio waves radiated from the antenna element.

Furthermore, when the polarization direction of the radio waves radiated from the power supply line and the polarization direction of the radio waves radiated from the antenna element are identical to each other, the coupling between the power supply line and the antenna element is strengthened. As a result, the power supply line may receive the radio waves radiated from the antenna element, and the power supply line may radiate the received radio waves as secondary radiation. These radio waves of secondary radiation may also cause noise.

The present disclosure reduces noise caused by radio waves radiated by a power supply line in an antenna module capable of radiating radio waves in two different directions.

An antenna module according to an aspect of the present disclosure includes a first antenna element disposed at a first dielectric substrate, a second antenna element disposed at a second dielectric substrate, a joint connecting the first dielectric substrate and the second dielectric substrate, and a power supply line. The second dielectric substrate is different from the first dielectric substrate with respect to the normal direction. The power supply line extends from the first dielectric substrate via the joint to the second antenna element and is configured to communicate radio-frequency signals to the second antenna element. At least a part of the power supply line at the joint is formed in a direction crossing the polarization plane of radio waves radiated by the first antenna element and the second antenna element.

An antenna module according to another aspect of the present disclosure includes a first antenna element disposed at a first dielectric substrate, a second antenna element disposed at a second dielectric substrate, a joint connecting the first dielectric substrate and the second dielectric substrate, and a power supply line. The power supply line extends from the first dielectric substrate via the joint to the second antenna element and is configured to communicate radio-frequency signals to the second antenna element. At least a part of the power supply line at the joint is formed in a direction crossing the polarization plane of radio waves radiated by the first antenna element and the second antenna element.

In the antenna module according to the present disclosure, at the joint connecting the two dielectric substrates at which antenna elements are formed, at least a part of the power supply line for communicating radio-frequency signals to the second antenna element is formed in a direction crossing the polarization plane of radio waves radiated by the second antenna element. With this configuration, the polarization direction of radio waves radiated by the power supply line is different from the polarization direction of radio waves radiated by the second antenna element, and as a result, the interference of radio waves between the power supply line and the second antenna element is hindered. Furthermore, the coupling between the power supply line and the second antenna element is weakened, and as a result, secondary radiation by the power supply line can be hindered. Consequently, it is possible to reduce noise caused by radio waves radiated by the power supply line.

BRIEF DESCRIPTION OF THE SEVERAL VIEWS OF THE DRAWINGS

FIG. 11 is a diagram for explaining an antenna device according to a fourth embodiment.

FIGS. 12A and 12B are diagrams for explaining an antenna device according to a fifth embodiment.

DETAILED DESCRIPTION

Figure 1:
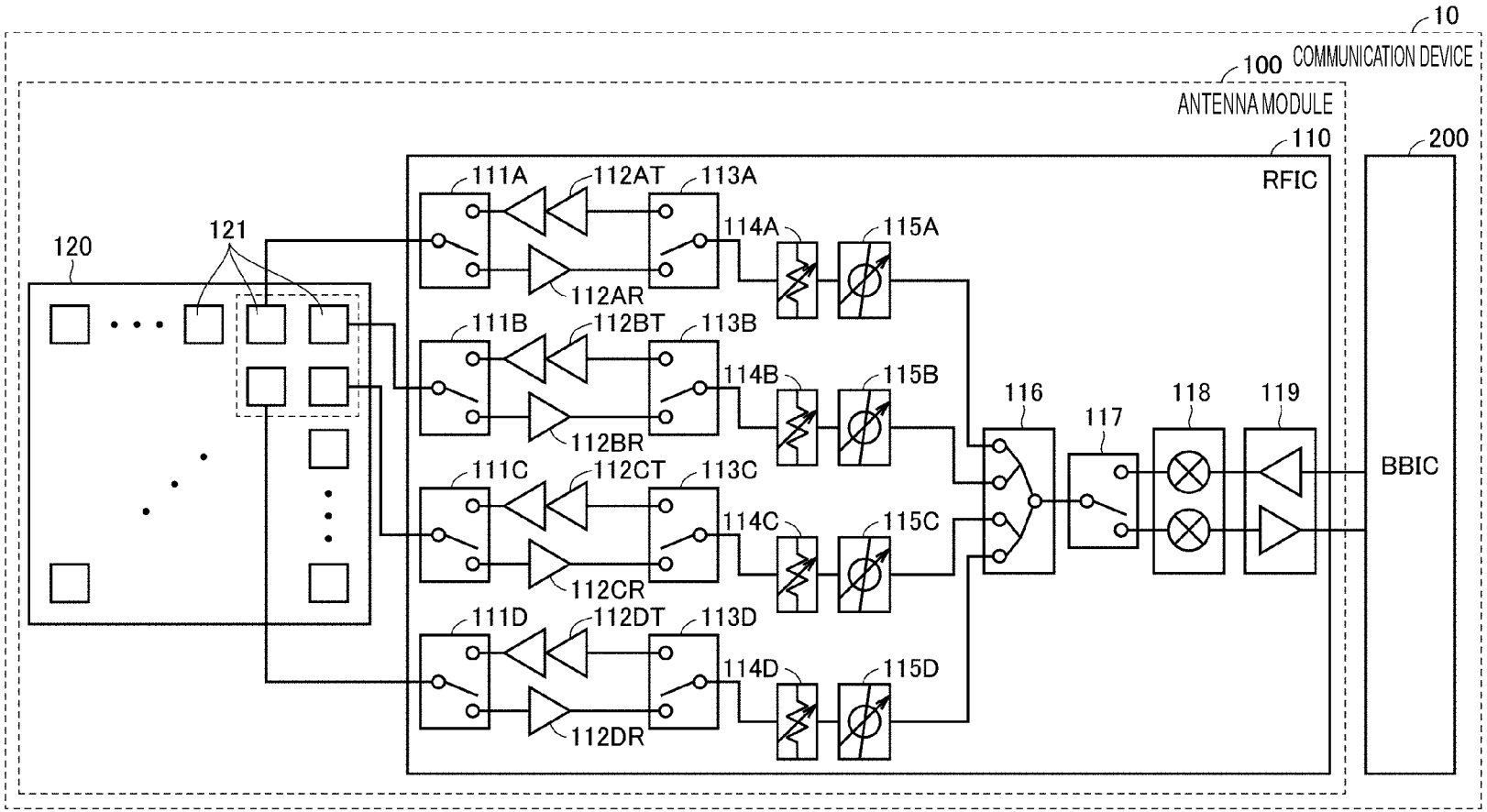
FIG. 1 is a block diagram of a communication device in which an antenna module according to a first embodiment is used.

Hereinafter, embodiments of the present disclosure will be described in detail with reference to the drawings. In the drawings, identical or corresponding portions are assigned identical reference characters, and descriptions thereof are not repeated.

First Embodiment (Basic Configuration of Communication Device)

FIG. 1 is a block diagram of a communication device 10 in which an antenna module 100 according to a first embodiment is used. Examples of the communication device 10 include portable terminals, such as a mobile phone, a smartphone, and a tablet computer, and a personal computer having communication functionality.

Referring to FIG. 1, the communication device 10 includes the antenna module 100 and a baseband integrated circuit (BBIC) 200 forming a baseband-signal processing circuit. The antenna module 100 includes a radio-frequency integrated circuit (RFIC) 110, which is an example of a feeding circuit, and an antenna device 120. In the communication device 10, a signal is communicated from the BBIC 200 to the antenna module 100, up-converted into a radio-frequency signal, and emitted from the antenna device 120; and a radio-frequency signal is received by the antenna device 120, down-converted, and processed by the BBIC 200.

For ease of description, FIG. 1 illustrates only configurations corresponding to four antenna elements 121 out of a plurality of antenna elements (feeding elements) 121 constituting the antenna device 120. Configurations corresponding to the other antenna elements 121 having the same configuration are omitted. While FIG. 1 illustrates an example in which the antenna device 120 is constituted by the plurality of antenna elements 121 arranged in a two-dimensional array, the antenna device 120 is not necessarily constituted by a plurality of antenna elements 121 but may be constituted by one antenna element 121. In the present embodiment, the antenna element 121 is a patch antenna formed as a substantially square flat plate.

The RFIC 110 includes switches 111A to 111D, 113A to 113D, and 117, power amplifiers 112AT to 112DT, low-noise amplifiers 112AR to 112DR, attenuators 114A to 114D, phase shifters 115A to 115D, a signal combiner and splitter 116, a mixer 118, and an amplifier circuit 119.

When a radio-frequency signal is transmitted, the switches 111A to 111D and 113A to 113D are switched to establish connection to the power amplifiers 112AT to 112DT and the switch 117 establishes connection to a transmit amplifier of the amplifier circuit 119. When a radio-frequency signal is received, the switches 111A to 111D and 113A to 113D are switched to establish connection to the low-noise amplifiers 112AR to 112DR and the switch 117 establishes connection to a receive amplifier of the amplifier circuit 119.

A signal communicated from the BBIC 200 is amplified by the amplifier circuit 119 and up-converted by the mixer 118. The up-converted transmit signal, which is a radio-frequency signal, is split into four signals by the signal combiner and splitter 116. The four signals pass through four signal paths and separately enter the different antenna elements 121. At this time, the phase shifters 115A to 115D disposed on the signal paths are adjusted with respect to phase, so that the directivity of the antenna device 120 can be controlled.

By contrast, radio-frequency signals received by the antenna elements 121 are communicated through four different signal paths and combined together by the signal combiner and splitter 116. The combined receive signal is down-converted by the mixer 118, amplified by the amplifier circuit 119, and communicated to the BBIC 200.

The RFIC 110 is formed as, for example, a one-chip integrated-circuit component having the circuit configuration described above. Alternatively, in the RFIC 110, the particular devices (the switches, the power amplifier, the low-noise amplifier, the attenuator, and the phase shifter) corresponding to each of the antenna elements 121 may be formed as a one-chip integrated-circuit component corresponding to each of the antenna elements 121.

(Antenna Module Arrangement)

Figure 2:
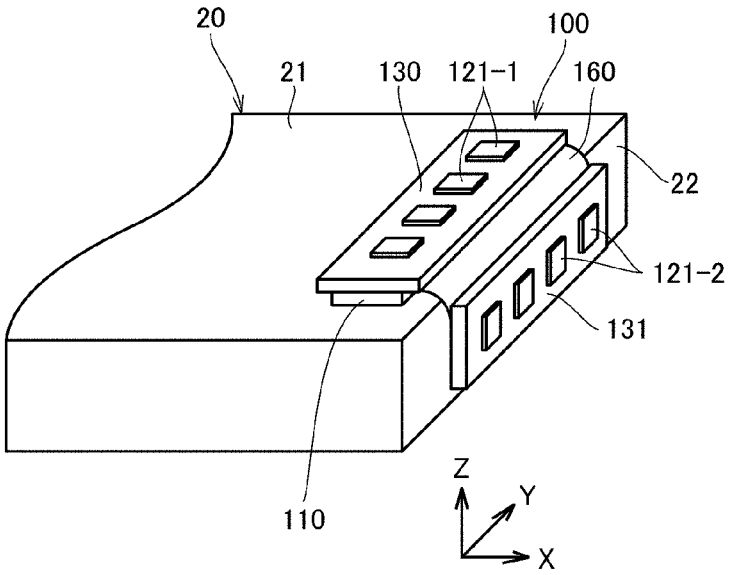
FIG. 2 is a perspective view for explaining an arrangement of the antenna module in FIG. 1.

FIG. 2 is a diagram for explaining an arrangement of the antenna module 100 according to the first embodiment. Referring to FIG. 2, the antenna module 100 is arranged at a major surface 21 of a mounting board 20 together with the RFIC 110 interposed between the antenna module 100 and the mounting board 20. At the RFIC 110, dielectric substrates 130 and 131 are arranged with a flexible substrate 160 having flexibility. The antenna elements 121-1 and 121-2 are respectively arranged at the dielectric substrates 130 and 131. The flexible substrate 160 corresponds to a "joint" of the present disclosure.

The frequency band of radio waves that the antenna module 100 according to the first embodiment can radiate is not particularly limited; for example, the antenna module 100 according to the first embodiment can be used for radio waves in millimeter wave bands, such as the 28 GHz band and/or the 39 GHz band.

The dielectric substrate 130 extends along the major surface 21. The antenna elements 121-1 are arranged to radiate radio waves in the normal direction of the major surface 21, that is, the Z-axis direction in FIG. 2.

The flexible substrate 160 curves from the major surface 21 to a side surface 22 of the mounting board 20. The dielectric substrate 131 is arranged at a part of the flexible substrate 160 contacting the side surface 22. At the dielectric substrate 131, the antenna elements 121-2 are arranged to radiate radio waves in the normal direction of the side surface 22, that is, the X-axis direction in FIG. 2. Instead of the flexible substrate 160, for example, a rigid substrate having thermoplasticity may be provided.

The dielectric substrates 130 and 131 and the flexible substrate 160 are formed of a resin, such as epoxy or polyimide. Alternatively, the flexible substrate 160 may be formed of a liquid crystal polymer (LCP) or a fluororesin, which have relatively low permittivity. The dielectric substrates 130 and 131 may also be formed of an LCP or a fluororesin.

By coupling the two dielectric substrates 130 and 131 with the use of the curved flexible substrate 160, it is possible to radiate radio waves in different two directions.

Figure 3:
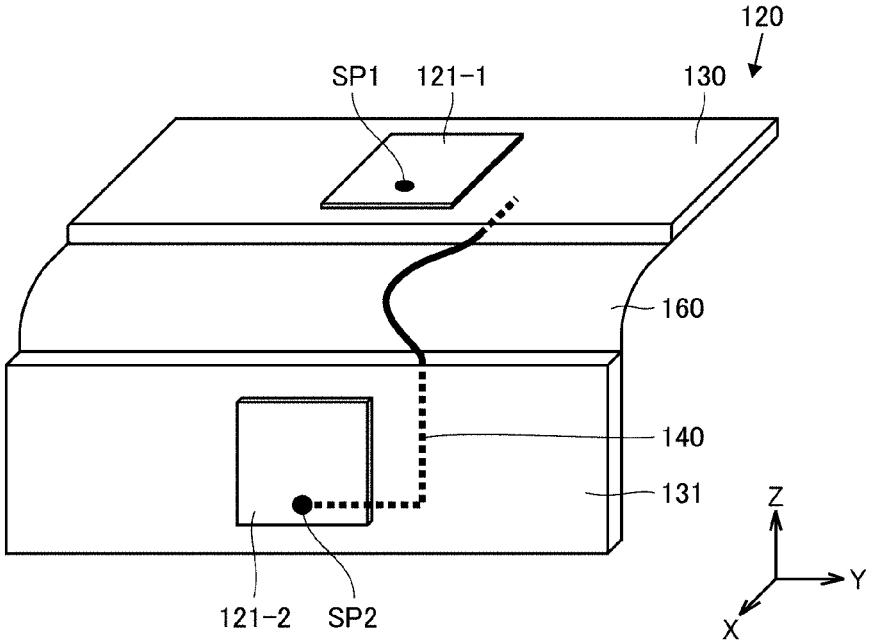
FIG. 3 is a first diagram for explaining details of an antenna device according to the first embodiment.
Figure 4:
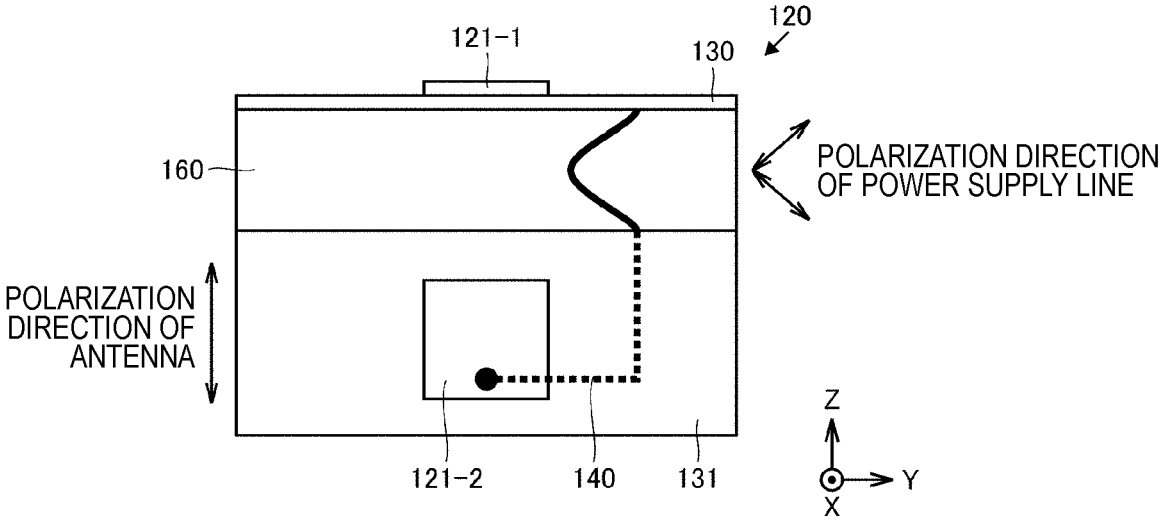
FIG. 4 is a second diagram for explaining details of the antenna device according to the first embodiment.
Figure 5:
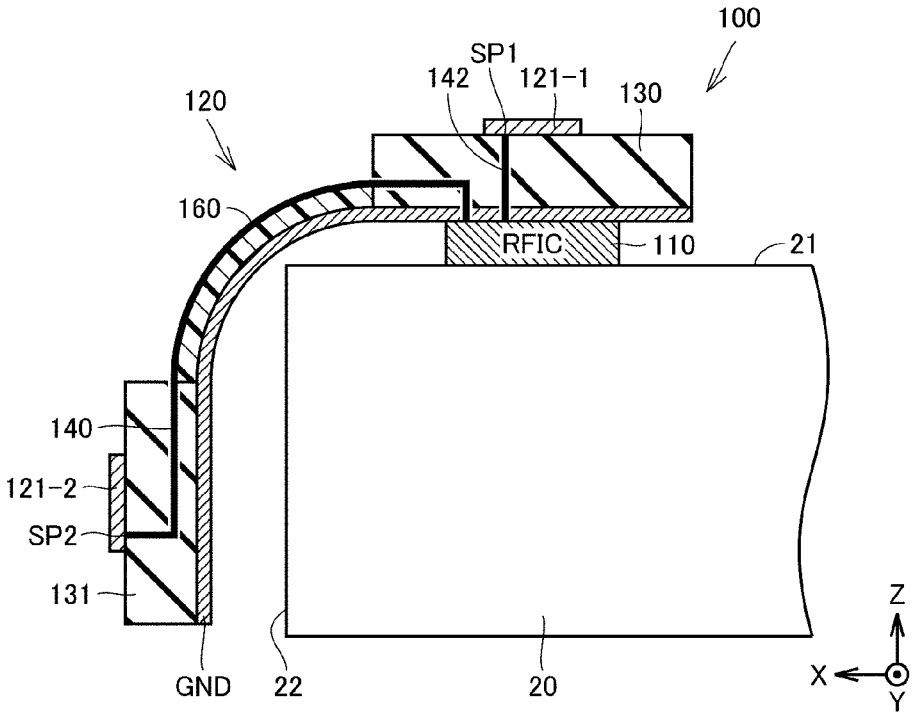
FIG. 5 is a sectional view of the antenna module when the antenna module is viewed from a side surface.

Next, details of the antenna device 120 according to the first embodiment will be described with reference to FIGS. 3 to 5. FIG. 3 is a perspective view of the antenna device 120. FIG. 4 is a view when the antenna device 120 is viewed in the normal direction of the dielectric substrate 131, that is, the forward direction of the X axis in FIG. 3. FIG. 5 is a sectional view of the antenna module 100 when viewed in a direction from a side surface of the antenna module 100, that is, the forward direction of the Y axis in FIG. 3. For ease of description, FIGS. 3 to 5, and FIGS. 6, 7, 9 to 11 described later use an example of configuration in which one antenna element 121 is disposed at each of the dielectric substrates 130 and 131; however, as illustrated in FIG. 2, a plurality of antenna elements 121 may be arranged in an array.

Referring to FIGS. 3 to 5, as illustrated in FIG. 2, the antenna device 120 is mounted at the mounting board 20 with the RFIC 110 interposed between the antenna device 120 and the mounting board 20. The dielectric substrate 130 faces the major surface 21 of the mounting board 20. The dielectric substrate 131 faces the side surface 22 of the mounting board 20. With respect to each of the dielectric substrates 130 and 131, a ground electrode GND is disposed at a surface opposite to the surface with the disposed antenna element 121, that is, a surface facing the mounting board 20.

The RFIC 110 inputs radio-frequency signals to the antenna element 121-1 disposed at the dielectric substrate 130 through a power supply line 142. In the example of FIG. 3, the power supply line 142 is connected to a feed point SP1 provided at a position offset from the center of the antenna element 121-1 in the forward direction of the X axis. As a result, polarization waves oscillating along the X axis are radiated in the forward direction of the Z axis by the antenna element 121-1.

The RFIC 110 inputs radio-frequency signals to the antenna element 121-2 disposed at the dielectric substrate 131 through a power supply line 140. The power supply line 140 extends from the dielectric substrate 130 to the dielectric substrate 131 while passing a surface of the flexible substrate 160 or through an inner layer of the flexible substrate 160 to be connected to a feed point SP2 of the antenna element 121-2. In the example of FIG. 3, the feed point SP2 is provided offset from the center of the antenna element 121-2 in the reverse direction of the Z axis. As a result, polarization waves oscillating along the Z axis are radiated in the forward direction of the X axis by the antenna element 121-2. While FIG. 3 illustrates an example in which the polarization plane of radio waves radiated by the antenna element 121-1 and the polarization plane of radio waves radiated by the antenna element 121-2 are both the ZX plane, the two polarization planes of radio waves may be different from each other.

The ground electrode GND is disposed at the inner surface of the flexible substrate 160, that is, the surface facing the mounting board 20 (FIG. 5); in other words, the power supply line 140 is formed as a microstripline at the flexible substrate 160. As described above, the ground electrode GND is provided at the surface facing the mounting board 20 in the dielectric substrates 130 and 131 and the flexible substrate 160. As a result, it is possible to hinder the leakage of radio waves radiated by the antenna element 121 or the power supply lines 140 and 142 to the mounting board 20 side. Furthermore, it is possible to hinder the transmission of noise or the like radiated by devices on the mounting board 20 side to the antenna elements 121 or the power supply lines 140 and 142.

In the first embodiment, as illustrated in FIG. 4, when the antenna device 120 is viewed in the forward direction of the X axis, the power supply line 140 at the flexible substrate 160 is not straight but curved or bent. This means that at least a part of the power supply line 140 at the flexible substrate 160 extends in a direction crossing the polarization plane (ZX plane) of radio waves radiated by the antenna elements 121-1 and 121-2.

Figure 6:
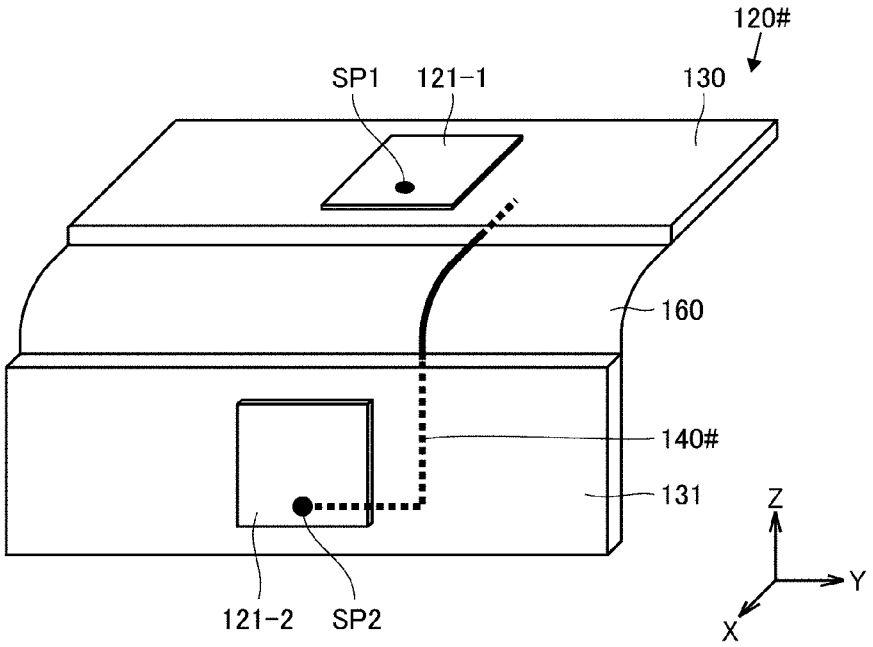
FIG. 6 is a first diagram for explaining an antenna device of a comparative example.
Figure 7:
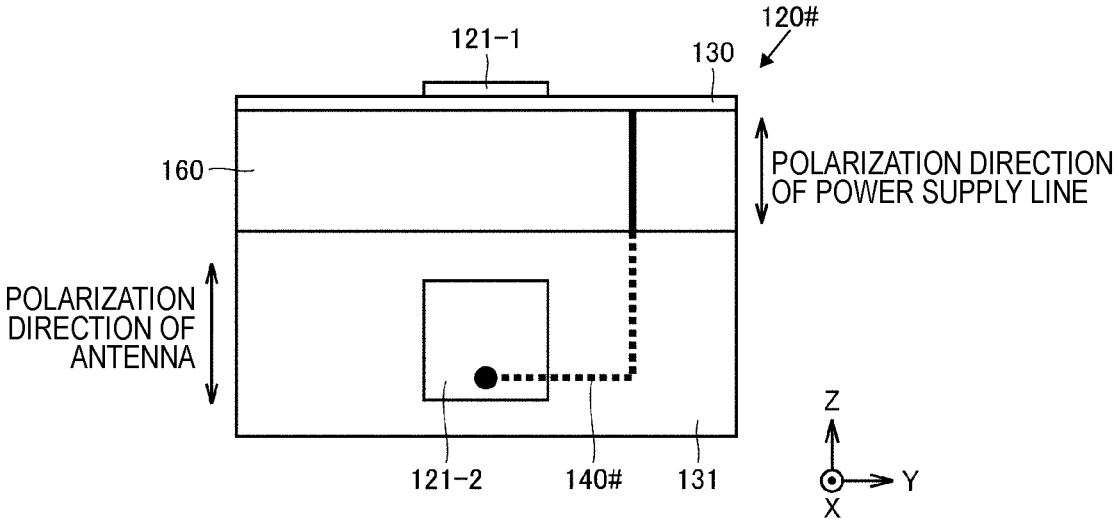
FIG. 7 is a second diagram for explaining the antenna device of the comparative example.

The power supply line 140 is formed in such a shape due to the reason described below by using a comparative example (FIGS. 6 and 7). FIGS. 6 and 7 illustrate an antenna device 120 # according to the comparative example. FIGS. 6 and 7 correspond to FIGS. 3 and 4 of the antenna device 120 of the first embodiment. The comparative example differs from the first embodiment in that a power supply line 140 # at the flexible substrate 160 is straight in the Z-axis direction when the antenna device 120 # is viewed in the forward direction of the X axis as illustrated in FIG. 7.

It is known that, usually, when current flows in a wiring line, an electromagnetic field is generated around the wiring line, so that the wiring line per se functions as an antenna. For this reason, when a radio-frequency signal is inputted to a power supply line so that current flows in the power supply line, the power supply line per se functions as an antenna and radiates radio waves. In this case, the polarization direction of radio waves radiated by the power supply line is the direction in which the power supply line extends. Hence, as in the comparative example in FIGS. 6 and 7, when the polarization plane of radio waves radiated by the antenna elements 121-1 and 121-2 is identical to the polarization plane of radio waves radiated the power supply line 140 #, the radio waves may interfere with each other and consequently cause noise.

When the polarization plane of radio waves radiated by the antenna elements 121-1 and 121-2 is parallel to the direction in which the power supply line 140 # extends, the power supply line 140 # also functions as a receive antenna and may receive the radio waves radiated by the antenna elements 121-1 and 121-2. This causes noise to the radio-frequency signal transmitted by the RFIC 110, and moreover, the received radio waves may be radiated again by the power supply line 140 # (secondary radiation).

By contrast, as in the first embodiment, when the direction in which at least a part of the power supply line 140 extends at the flexible substrate 160 and the polarization plane of radio waves radiated by the antenna elements 121-1 and 121-2 are not parallel to each other but cross each other, the power supply line 140 and the antenna elements 121-1 and 121 differ from each other with respect to the polarization plane of radiated radio waves, and as a result, the interference of radio waves between the power supply line 140 and the antenna elements 121-1 and 121 is hindered. Furthermore, the power supply line 140 in the flexible substrate 160 is unlikely to receive radio waves radiated by the antenna elements 121-1 and 121-2, and as a result, it is possible to hinder secondary radiation by the power supply line 140.

When the joint is formed as the flexible substrate 160, since the flexible substrate 160 is bent, stress may act on the power supply line 140 at the flexible substrate 160. As in the comparative example illustrated in FIGS. 6 and 7, when the power supply line 140 is straight at the flexible substrate 160 and has a shortest length, the stress caused by bending or stretching the flexible substrate 160 tends to significantly affect the power supply line 140. By contrast, as in the first embodiment, when at least a part of the power supply line 140 is, for example, curved at the flexible substrate 160, it is possible to achieve the effect of reducing the stress caused by bending or stretching the flexible substrate 160.

Figure 8A:
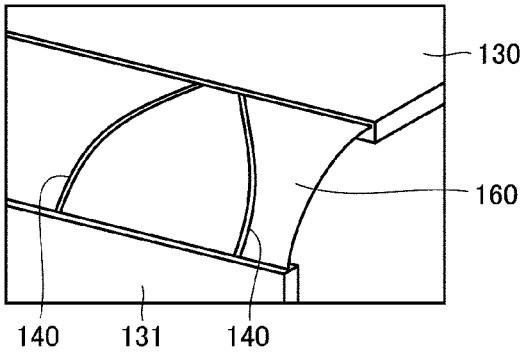
FIGS. 8A, 8B, and 8C provide diagrams illustrating examples of other arrangements of power supply lines formed at a joint.

It should be noted that the shape of the power supply line 140 at the flexible substrate 160 is not limited to a complete curve as illustrated in FIG. 3. For example, as illustrated in FIG. 8A, the power supply line 140 may be almost straight but inclined at a particular angle in the direction from the dielectric substrate 131 to the dielectric substrate 130.

Figure 8B:
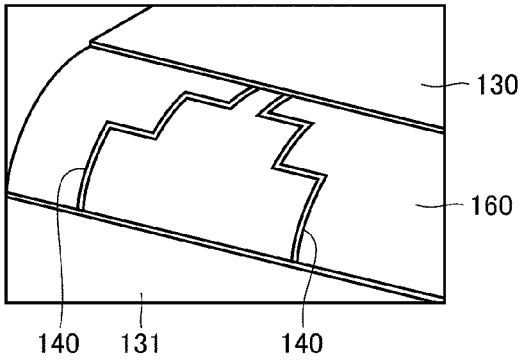

In the example in FIG. 8B, the power supply line 140 at the flexible substrate 160 is formed like a staircase; and thus, the portion parallel to the polarization plane of radio waves radiated by the antenna elements 121-1 and 121-2 and the portion perpendicular to the polarization plane of radio waves radiated by the antenna elements 121-1 and 121-2 appear in an alternating manner. In the example in FIG. 8C, the power supply line 140 is composed of the portion extending parallelly to the polarization plane of radio waves radiated by the antenna elements 121-1 and 121-2 and the portion inclined with respect to the polarization plane of radio waves radiated by the antenna elements 121-1 and 121-2.

In the examples illustrated in FIGS. 8(*b*) and 8(*c*), a particular part of the power supply line 140 at the flexible substrate 160 extends parallelly to the polarization plane of radio waves radiated by the antenna elements 121-1 and 121-2. However, when the length of the particular parallel part in each example is shorter than ½ of the wave length of radiated radio waves, it is possible to hinder the interference with the radio waves radiated by the antenna elements 121-1 and 121-2 and the coupling between the radio waves radiated by the antenna elements 121-1 and 121-2 and the radio waves radiated by the power supply line 140.

As described above, in the antenna module in which two dielectric substrates having antenna elements are coupled to each other by using the joint (flexible substrate), at least a part of the power supply line formed at the flexible substrate is formed in the direction crossing the polarization plane of radio waves radiated by the antenna elements to which radio-frequency signals are inputted through the power supply line, and as a result, it is possible to reduce noise caused by radio waves radiated by the power supply line.

Second Embodiment

The first embodiment described an example in which the antenna element radiates radio waves of one polarization direction. A second embodiment describes an example of the dual-polarization antenna module in which the antenna element radiates two kinds of polarization waves.

The following description about the second embodiment uses the example in which the antenna element 121-2 is a dual-polarization antenna element, but the antenna element 121-1 may also be a dual-polarization antenna element in addition to the antenna element 121-2.

Figure 9:
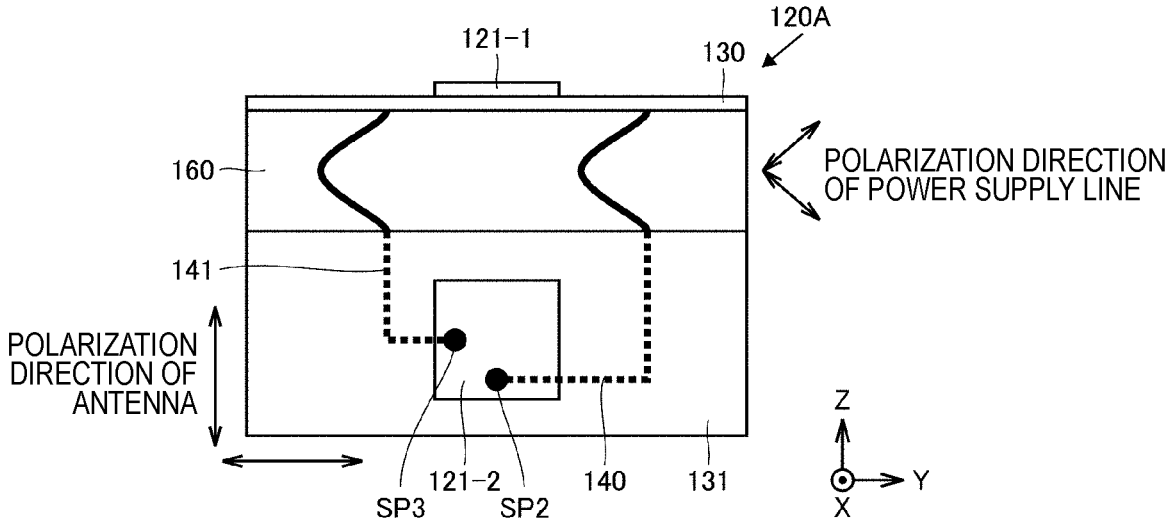
FIG. 9 is a diagram for explaining an antenna device according to a second embodiment.

FIG. 9 is a diagram for explaining an antenna device 120A according to the second embodiment. In the antenna device 120A in FIG. 9, the power supply line 140 is connected to the antenna element 121-2 at the feed point SP2, while a power supply line 141 is connected to the antenna element 121-2 at a feed point SP3. The feed point SP2 is positioned offset from the center of the antenna element 121-2 in the reverse direction of the Z axis. The feed point SP3 is positioned offset from the center of the antenna element 121-2 in the reverse direction of the Y axis. As a result, the antenna element 121-2 radiates a polarization wave oscillating along the Z axis (first polarization wave) and a polarization wave oscillating along the Y axis (second polarization wave). This means that the polarization plane of radio waves radiated by the antenna element 121-2 is both the XY plane and the ZX plane.

In the antenna device 120A in FIG. 9, similarly to the first embodiment, the power supply lines 140 and 141 curve at the flexible substrate 160. This means that each of the power supply lines 140 and 141 at the flexible substrate 160 at least partially includes a first portion and a second portion; the first portion extends in the direction crossing the polarization plane of the first polarization wave radiated by the antenna element 121-2 (ZX plane); the second portion extends in the direction crossing the polarization plane of the second polarization wave (the XY plane).

Consequently, also with the antenna device 120A, it is possible to hinder the interference between the radio waves radiated by the antenna element 121-2 and the radio waves radiated by the power supply lines 140 and 141 and also hinder secondary radiation by the power supply lines 140 and 141.

Figure 8C:
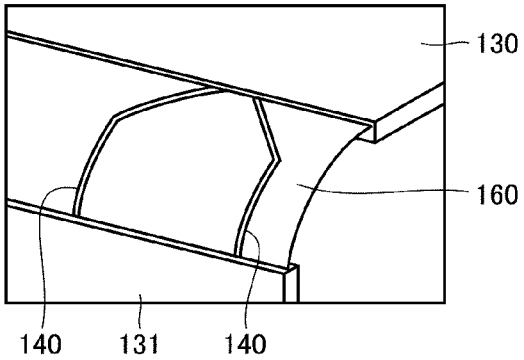

The power supply lines 140 and 141 of the second embodiment can also be formed in various shapes as illustrated in FIGS. 8A-8C.

Third Embodiment

In an antenna module, to match the impedance of the RFIC and the impedance of the antenna element and/or to optimize the frequency band of radiated radio waves, a matching circuit is provided for the power supply line in some cases; the matching circuit is represented by a stub provided in a branch of the power supply line.

A third embodiment describes a configuration in which a matching circuit provided for the power supply line is disposed at the joint (flexible substrate) connecting two dielectric substrates.

Figure 10:
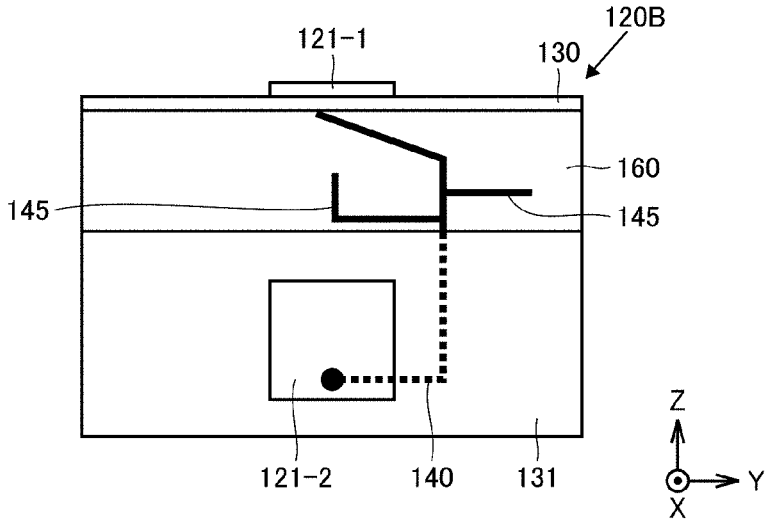
FIG. 10 is a diagram for explaining an antenna device according to a third embodiment.

FIG. 10 is a diagram for explaining an antenna device 120B according to the third embodiment. In the antenna device 120B, the power supply line 140 at the flexible substrate 160 is composed of the portion extending parallelly to the polarization plane of radio waves radiated by the antenna elements 121-1 and 121-2 and the portion inclined with respect to the polarization plane of radio waves radiated by the antenna elements 121-1 and 121-2 as illustrated in FIG. 8C. A stub 145 is disposed at the portion extending parallelly to the polarization plane at the flexible substrate 160.

In a usual antenna module with a stub, the stub is in many cases disposed at the power supply line formed in a dielectric substrate. In this case, the stub may need to be disposed in a limited area due to the limitation of the size of the dielectric substrate; or conversely, the dielectric substrate may need to be enlarged to have a space for disposing the stub. Particularly, in the case of an array antenna including a plurality of antenna elements, it is suitable to avoid any overlap between the stub and adjacent antenna elements, and thus, the problem described above may be more profound.

In the antenna device 120B according to the third embodiment, the stub 145 is disposed at a part of the power supply line 140 formed at the flexible substrate 160, and as a result, it is possible to improve the antenna characteristics. Moreover, in comparison to the case in which the stub is disposed on the dielectric substrate 131 side, it is possible to increase the flexibility for design and also increase the area efficiency of the dielectric substrate.

Fourth Embodiment

A fourth embodiment describes a case in which a filter circuit is formed at a part of the power supply line formed at the flexible substrate.

FIG. 11 is a diagram for explaining an antenna device 120C according to the fourth embodiment. In the example of the antenna device 120C in FIG. 11, a part of the power supply line 140 formed at the flexible substrate 160 extends in the Y-axis direction, and a filter circuit 150 is disposed at the part extending in the Y-axis direction. It should be noted that the position of the filter circuit 150 is not limited to the part extending in the Y-axis direction, but the filter circuit 150 can be disposed at any position in the power supply line 140 formed at the flexible substrate 160.

The filter circuit 150 can be used, for example, to perform impedance matching as the stub described in the third embodiment, to remove harmonic waves acting as noise added to radio-frequency signals transmitted through the power supply line 140, or to improve the frequency characteristic of the antenna device 120C.

Similarly to the third embodiment, disposing the filter circuit 150 at the dielectric substrate 131 may limit design or decrease the area efficiency of the dielectric substrate. Thus, similarly to the third embodiment, when the filter circuit needs to be provided for the power supply line, the filter circuit is disposed at a part of the power supply line formed at the flexible substrate; and consequently, it is possible to increase the flexibility for design and also increase the area efficiency of the dielectric substrate while improving the antenna characteristics.

Fifth Embodiment

The above embodiments have described the case in which each radiating element radiates radio waves in one frequency band. A fifth embodiment describes an example of an antenna module including radiating elements capable of radiating radio waves in two frequency bands, that is, dual-band radiating elements.

FIGS. 12A and 12B are diagrams for explaining an antenna device 120D according to the fifth embodiment. FIG. 12A is a view when the antenna device 120D is viewed in the normal direction of the dielectric substrate 131. FIG. 12B is a sectional view of the dielectric substrate 131 in the ZX plane.

Referring to FIGS. 12A and 12B, the antenna device 120D includes, as radiating elements provided at the dielectric substrate 131, a parasitic element 122 to which no radio-frequency signal is inputted, in addition to the antenna element 121-2 (hereinafter also referred to as "feeding element") to which radio-frequency signals are inputted through the power supply line 140. The parasitic element 122 is formed in a substantially square shape of a size slightly larger than the feeding element 121-2. The parasitic element 122 is formed between the feeding element 121-2 and the ground electrode GND in the dielectric substrate 131. When the dielectric substrate 131 is viewed in plan view in the normal direction of the dielectric substrate 131, the parasitic element 122 overlaps at least a part of the feeding element 121-2 (FIG. 12A).

The power supply line 140 in the dielectric substrate 131 passes between the parasitic element 122 and the ground electrode GND, penetrates a hole formed in the parasitic element 122, and is connected to the feeding element 121-2 (FIG. 12B). Since the parasitic element 122 is formed as described above, the parasitic element 122 can radiate radio waves in a frequency band different from the frequency band of the radio waves radiated by the feeding element 121-2. In the example in FIGS. 12A and 12B, the through-hole of the parasitic element 122 is formed offset from the center of the parasitic element 122 in the reverse direction of the Z axis, and thus, the polarization plane of radio waves radiated by the parasitic element 122 is the ZX plane similarly to the polarization plane of the feeding element 121-2.

This dual-band antenna device 120D is also configured such that at least a part of the power supply line 140 at the flexible substrate 160 is formed in a direction crossing the polarization plane of the feeding element 121-2 and the parasitic element 122, and as a result, it is possible to reduce noise caused by radio waves radiated by the power supply line 140.

While in the example in FIGS. 12A and 12B only the antenna element 121-2 is a dual-band antenna element, the antenna element 121-1 may also be a dual-band antenna element.

Sixth Embodiment

A sixth embodiment describes an example of an array antenna composed of a plurality of antenna elements disposed at the dielectric substrate.

Figure 13:
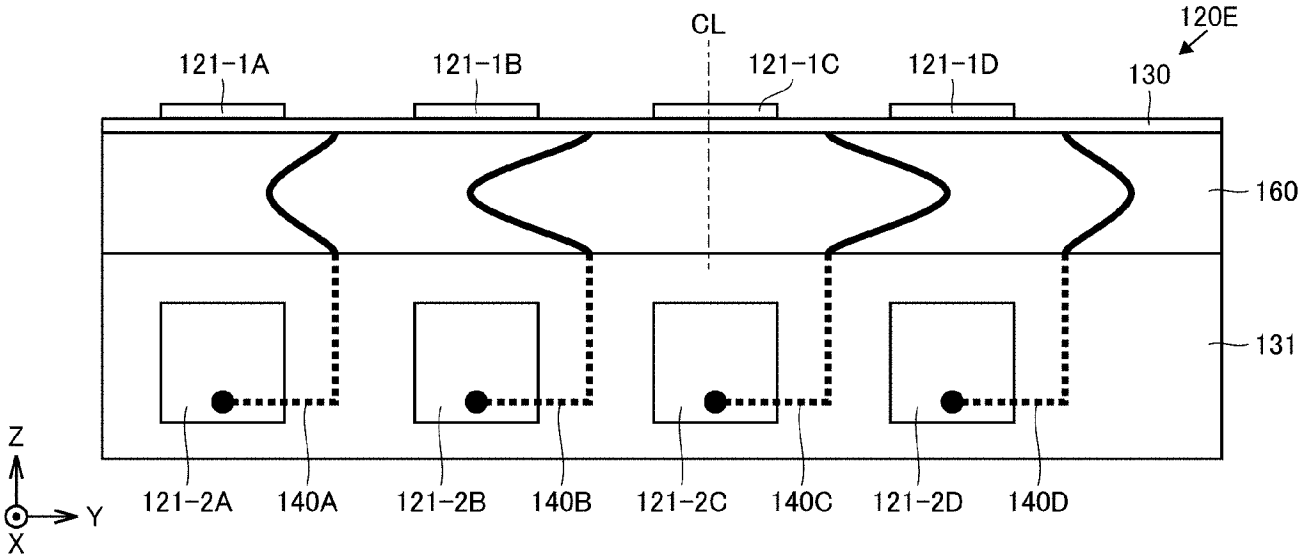
FIG. 13 is a diagram for explaining an antenna device according to a sixth embodiment.

FIG. 13 is a diagram for explaining an antenna device 120E according to the sixth embodiment. In the antenna device 120E, four antenna elements 121A to 121D are arranged in the Y-axis direction at the dielectric substrate 131. Power supply lines 140A to 140D are connected respectively to the antenna elements 121A to 121D. Through the power supply lines 140A to 140D, radio-frequency signals from the RFIC 110 are inputted to the antenna elements 121A to 121D.

In each of the antenna elements 121A to 121D, a feed point is positioned offset from the center of the corresponding antenna element in the reverse direction of the Z axis, and as a result, each antenna element radiates a polarization wave in the forward direction of the X axis. The polarization wave oscillates along the Z axis.

Similarly to the other embodiments, as for the power supply lines 140A to 140D, at least a part of the power supply line at the flexible substrate 160 extends in a direction crossing the polarization plane of radio waves radiated by the corresponding antenna element (the ZX plane). As a result, it is possible to reduce noise caused by radio waves radiated by the power supply line.

It should be noted that, in the array antenna as illustrated in FIG. 13, it is suitable that the power supply line 140A to 140D are not parallel to each other at the flexible substrate 160. With this configuration, it is possible to hinder the interference among radio waves radiated by the power supply lines and also hinder the coupling among the power supply lines.

Furthermore, in FIG. 13, in the flexible substrate 160, the power supply line 140A and the power supply line 140D are symmetrical about a line CL parallel to the Z axis; the power supply line 140B and the power supply line 140C are also symmetrical about the line CL. With this configuration, radio waves radiated by the power supply line 140A and radio waves radiated by the power supply line 140D are in antiphase, and thus, the radio waves cancel each other out, which reduces the effects of spurious waves. Similarly, radio waves radiated by the power supply line 140B and radio waves radiated by the power supply line 140C are in antiphase, and thus, the radio waves cancel each other out. As such, the power supply lines 140A to 140D have line symmetry about the line CL at the flexible substrate 160, and as a result, it is possible to reduce the effect of radio waves radiated by the power supply lines.

Figure 14:
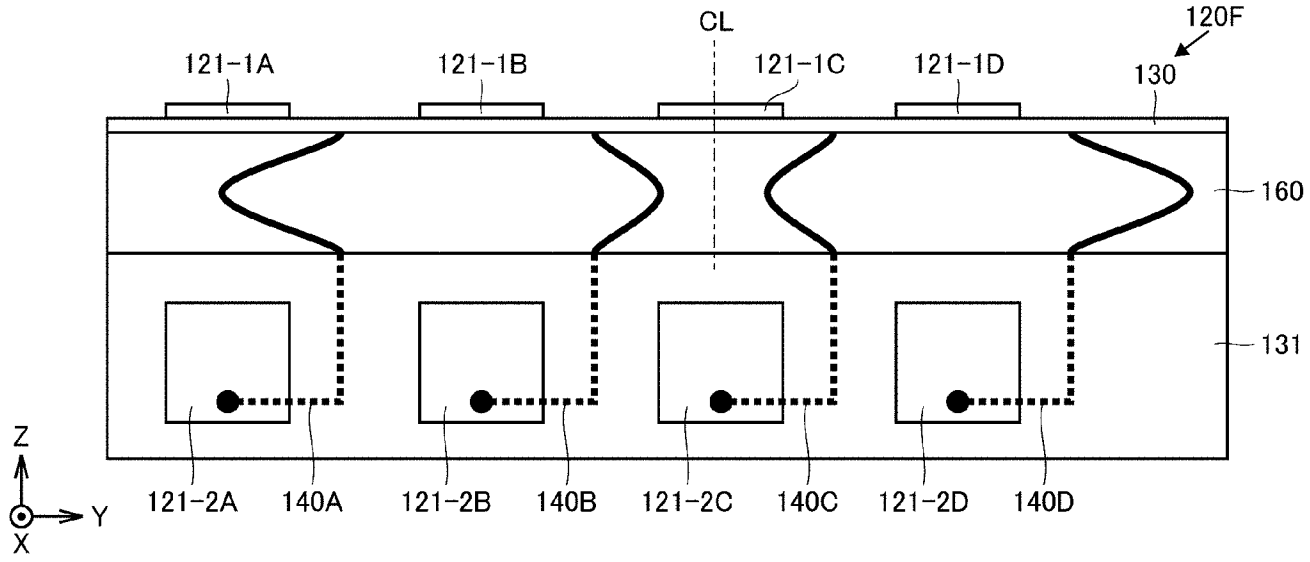
FIG. 14 is a diagram for explaining a first modified example of the antenna device according to the sixth embodiment.
Figure 15:
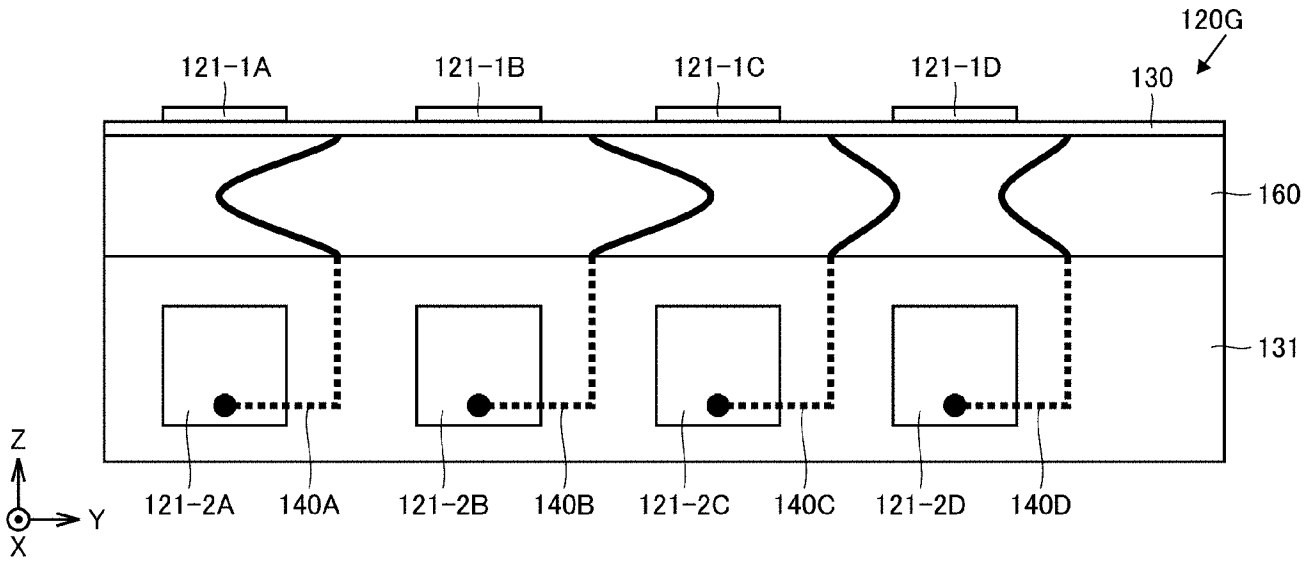
FIG. 15 is a diagram for explaining a second modified example of the antenna device according to the sixth embodiment.

Here, when the power supply lines 140A to 140D have overall line symmetry, the arrangement of the power supply lines 140A to 140D is not limited to the arrangement in FIG. 13; for example, the arrangement as in the antenna device 120F illustrated in FIG. 14 may be used. When radiated radio waves can cancel each other out, the arrangement of the power supply lines does not necessarily have overall line symmetry as illustrated as the antenna device 120G in FIG. 15. However, in view of the symmetry of radio waves radiated from the entire array antenna, it is suitable to use the symmetrical arrangements as in FIGS. 13 and 14.

The length of each of the power supply line 140A to 140D at the flexible substrate 160 may be adjusted such that the power supply lines from the RFIC 110 to the individual antenna element may be equal in length to each other. By equalizing the length among the power supply lines, it is possible to match radio-frequency signals inputted to the individual antenna elements with respect to phase.

While the fourth to sixth embodiments have describe the case in which the plurality of antenna elements 121 disposed at the dielectric substrate 130 and the dielectric substrate 131 are all patch antennas, one or some of the plurality of antenna elements may be dipole antennas.

Seventh Embodiment

The above embodiments have describe the case in which the polarization direction of radio waves radiated by the antenna element 121-1 disposed at the dielectric substrate 130 is a direction from the flexible substrate 160 toward the dielectric substrate 131 along the dielectric substrate 130, that is, the X-axis direction; the polarization direction of radio waves radiated by the antenna element 121-2 disposed at the dielectric substrate 131 is a direction from the flexible substrate 160 toward the dielectric substrate 130 along the dielectric substrate 131, that is, the Z-axis direction.

A seventh embodiment describes a case in which the polarization direction of radio waves radiated by the antenna element 121-1 disposed at the dielectric substrate 130 and the polarization direction of radio waves radiated by the antenna element 121-2 disposed at the dielectric substrate 131 are both the Y-axis direction.

Figure 16:
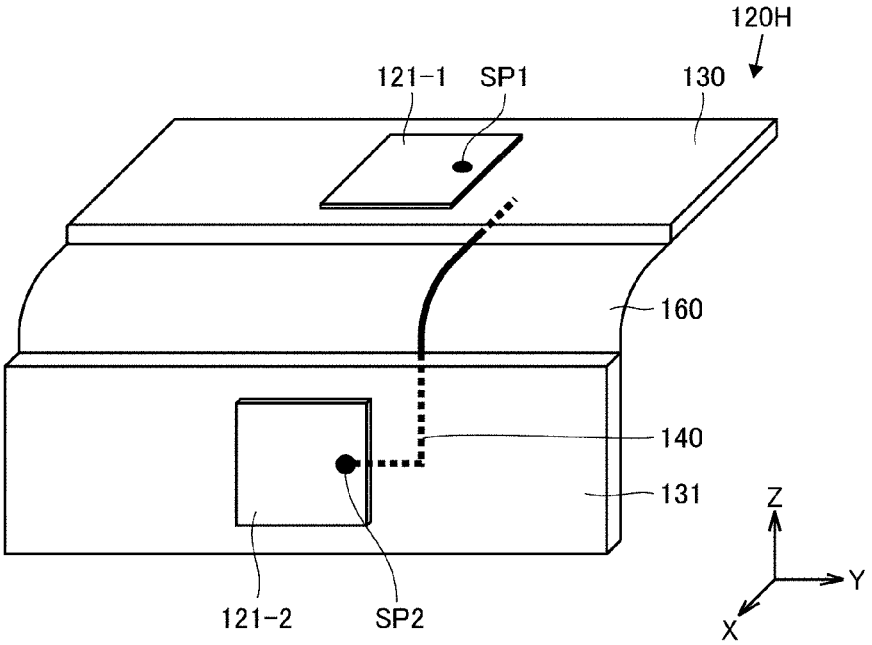
FIG. 16 is a diagram for explaining an antenna device according to a seventh embodiment.

FIG. 16 is a diagram for explaining an antenna device 120H according to the seventh embodiment. Referring to FIG. 16, in the antenna device 120H, a feed point SP1 of the antenna element 121-1 disposed at the dielectric substrate 130 is positioned offset from the center of the antenna element 121-1 in the forward direction of the Y axis. The feed point SP2 of the antenna element 121-2 disposed at the dielectric substrate 131 is positioned offset from the center of the antenna element 121-2 in the forward direction of the Y axis. As a result, the antenna element 121-1 radiates in the forward direction of the Z axis the polarization waves oscillating along the Y axis, while the antenna element 121-2 radiates in the forward direction of the X axis the polarization waves oscillating along the Y-axis direction.

As illustrated in FIG. 16, in the antenna device 120H, when the antenna device 120H is viewed in the forward direction of the X axis, the power supply line 140 at the flexible substrate 160 is straight in the Z-axis direction from the dielectric substrate 130 toward the dielectric substrate 131. In the case of the antenna device 120H, the polarization direction of radio waves radiated by the antenna element 121-1 and the polarization direction of radio waves radiated by the antenna element 121-2 are both the Y-axis direction (YZ plane/XY plane); and as a result, when the power supply line 140 at the flexible substrate 160 is not curved or bent, the polarization direction of radio waves radiated by the antenna elements 121-1 and 121-2 do not coincide with the polarization plane of radio waves radiated by the power supply line 140 at the flexible substrate 160 (ZX plane).

As described above, as the antenna device 120H, when the polarization direction of radio waves radiated by the antenna elements is perpendicular to the direction from the dielectric substrate 130 toward the dielectric substrate 131, in the case in which the power supply line 140 at the flexible substrate 160 is straight in the Z-axis direction when the antenna device 120H is viewed in the forward direction of the X axis, the power supply line 140 can be positioned to cross radio waves radiated by the antenna elements. Consequently, it is possible to hinder secondary radiation by the power supply line 140 and reduce noise caused by radio waves radiated by the power supply line 140.

It should be noted that, as the antenna device 120H, when the polarization direction of radio waves radiated by the antenna elements is the Y-axis direction, the power supply line may be curved or bent at the flexible substrate 160 as illustrated in FIGS. 3 and 8.

Eighth Embodiment

The above embodiments have described the case in which two dielectric substrates are different from each other with respect to the normal direction. An eighth embodiment describes a case in which two dielectric substrates of the same normal direction are connected to each other by a flexible substrate.

Figure 17:
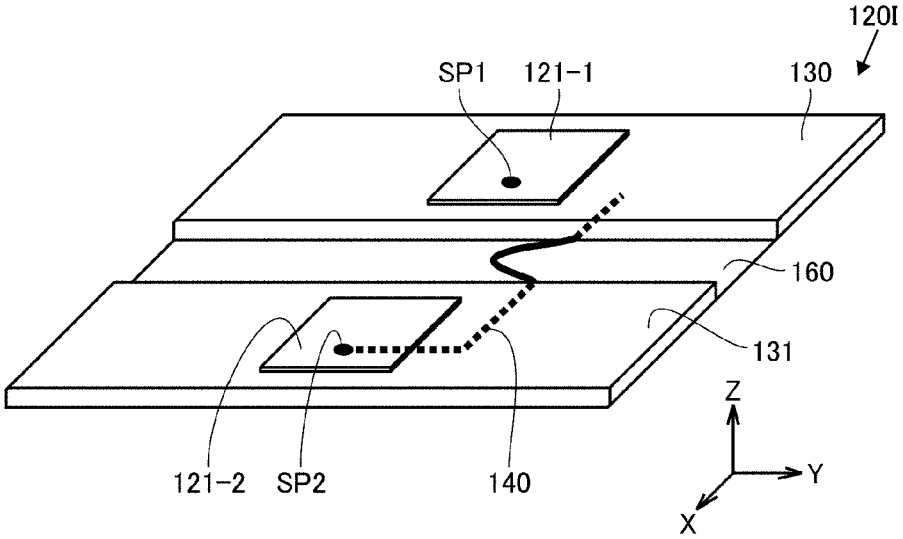
FIG. 17 is a diagram for explaining an antenna device according to an eighth embodiment.

FIG. 17 is a diagram for explaining an antenna device 1201 according to the eighth embodiment. In the antenna device 1201, the flexible substrate 160 is not bent, and the dielectric substrates 130 and 131 are formed in the same plane (XY plane) with the flexible substrate 160. The feed point SP1 of the antenna element 121-1 disposed at the dielectric substrate 130 and the feed point SP2 of the antenna element 121-2 disposed at the dielectric substrate 131 are each positioned offset from the center of the corresponding antenna element in the forward direction of the X axis. As a result, both the antenna elements 121-1 and 121-2 radiate in the forward direction of the Z axis the polarization waves oscillating along the X axis.

At this time, the power supply line 140 at the flexible substrate 160 is curved or bent when the antenna device 1201 is viewed in the Z-axis direction. This means that at least a part of the power supply line 140 at the flexible substrate 160 extends in a direction crossing the polarization plane (ZX plane) of radio waves radiated by the antenna elements 121-1 and 121-2.

This configuration makes the polarization plane of radio waves radiated by the power supply line 140 and the polarization plane of radio waves radiated by the antenna elements 121-1 and 121-2 (ZX plane) different from each other, and thus, it is possible to hinder secondary radiation by the power supply line 140 and reduce noise caused by radio waves radiated by the power supply line 140.

It should be noted that the antenna element 121-2 disposed at the dielectric substrate 131 is not limited to a patch antenna but may be a linear antenna, such as a dipole antenna.

The embodiments disclosed herein should be considered as an example in all respects and not construed in a limiting sense. The scope of the present disclosure is indicated by not the above description of the embodiments but the claims, and all changes which come within the meaning and range of equivalency of the claims are therefore intended to be embraced therein.

REFERENCE SIGNS LIST

10 communication device; 20 mounting board; 21 major surface; 22 side surface; 100 antenna module; 110 RFIC; 111A to 111D, 113A to 113D, 117 switch; 112AR to 112DR low-noise amplifier; 112AT to 112DT power amplifier; 114A to 114D attenuator; 115A to 115D phase shifter; 116 signal combiner and splitter; 118 mixer; 119 amplifier circuit; 120, 120A to 1201 antenna device; 121, 121A to 121D, 121-1, 121-1A to 121-1D, 121-2, 121-2A to 121-2D antenna element; 122 parasitic element; 130, 131 dielectric substrate; 140, 140A to 140D, 141, 142 power supply line; 145 stub; 150 filter circuit; 160 flexible substrate; 200 BBIC; GND ground electrode; SP1 to SP3 feed point

The invention claimed is:

1. An antenna module comprising:

a first dielectric substrate;

a second dielectric substrate having a different normal direction than the first dielectric substrate;

a first antenna at the first dielectric substrate;

a second antenna at the second dielectric substrate;

a joint connecting the first dielectric substrate and the second dielectric substrate; and a first power supply line extending from the first dielectric substrate to the second antenna via the joint, the first power supply line being configured to communicate a radio-frequency signal to the second antenna;

wherein at least a part of the first power supply line at the joint is in a direction that crosses a polarization plane of radio waves radiated by the first antenna and the second antenna, wherein the first power supply line at the joint is a microstripline, wherein the joint curves from the first dielectric substrate toward the second dielectric substrate, and a ground electrode of the microstripline is at an inner surface of the curved joint.

2. The antenna module according to claim 1, wherein:

the second antenna is configured to radiate a first polarization wave and a second polarization wave, and the first power supply line at the joint comprises a first portion that is in a direction crossing a polarization plane of the first polarization wave, and a second portion that is in a direction crossing a polarization plane of the second polarization wave.

3. The antenna module according to claim 1, further comprising:

a matching circuit at the first power supply line at the joint.

4. The antenna module according to claim 1, further comprising:

a filter circuit at the first power supply line at the joint.

5. The antenna module according to claim 1, further comprising:

a third antenna at the second dielectric substrate; and a second power supply line extending from the first dielectric substrate to the third antenna via the joint, and configured to communicate a radio-frequency signal to the third antenna, wherein at least a part of the second power supply line at the joint is in a direction crossing a polarization plane of radio waves radiated by the third antenna.

6. The antenna module according to claim 5, wherein the first power supply line and the second power supply line are not parallel to each other at the joint.

7. The antenna module according to claim 5, wherein the first power supply line and the second power supply line have line symmetry at the joint.

8. The antenna module according to claim 5, further comprising:

a feeding circuit at the first dielectric substrate that is configured to input a radio-frequency signal to the second antenna and to the third antenna, wherein the first power supply line from the feeding circuit to the second antenna has a same length as the second power supply line from the feeding circuit to the third antenna.

9. An antenna module comprising:

a first dielectric substrate;

a second dielectric substrate having a different normal direction than the first dielectric substrate;

a first antenna at the first dielectric substrate;

a second antenna at the second dielectric substrate;

a joint connecting the first dielectric substrate and the second dielectric substrate;

a first power supply line extending from the first dielectric substrate to the second antenna via the joint, the first power supply line being configured to communicate a radio-frequency signal to the second antenna;

a ground electrode at the second dielectric substrate; and a parasitic circuit element between the second antenna and the ground electrode, wherein at least a part of the first power supply line at the joint is in a direction that crosses a polarization plane of radio waves radiated by the first antenna and the second antenna, wherein the second dielectric substrate has a multilayer structure, and wherein the first power supply line penetrates the parasitic circuit element so as to be coupled to the second dielectric substrate.

10. The antenna module according to claim 9, wherein the first power supply line at the joint is a microstripline.

11. The antenna module according to claim 9, wherein:

the second antenna is configured to radiate a first polarization wave and a second polarization wave, and the first power supply line at the joint comprises a first portion that is in a direction crossing a polarization plane of the first polarization wave, and a second portion that is in a direction crossing a polarization plane of the second polarization wave.

12. The antenna module according to claim 9 further comprising:

a matching circuit at the first power supply line at the joint.

13. The antenna module according to claim 9, further comprising:

a filter circuit at the first power supply line at the joint.

14. An antenna module comprising:

a first dielectric substrate;

a second dielectric substrate;

a first antenna at the first dielectric substrate;

a second antenna at the second dielectric substrate;

a joint connecting the first dielectric substrate and the second dielectric substrate;

a power supply line extending from the first dielectric substrate to the second antenna via the joint, the power supply line being configured to communicate a radio-frequency signal to the second antenna;

a ground electrode at the second dielectric substrate; and a parasitic circuit element between the second antenna and the ground electrode, wherein at least a part of the power supply line at the joint is in a direction that crosses a polarization plane of radio waves radiated by the first antenna and the second antenna, wherein the second dielectric substrate has a multilayer structure, and wherein the power supply line penetrates the parasitic circuit element so as to be coupled to the second dielectric substrate.

15. The antenna module according to claim 14, wherein:

the second antenna is configured to radiate a first polarization wave and a second polarization wave, and the power supply line at the joint comprises a first portion that is in a direction crossing a polarization plane of the first polarization wave, and a second portion that is in a direction crossing a polarization plane of the second polarization wave.

16. The antenna module according to claim 14, further comprising:

a matching circuit at the power supply line at the joint.

17. The antenna module according to claim 14, further comprising:

a filter circuit at the power supply line at the joint.

18. The antenna module according to claim 14, wherein the power supply line at the joint is a microstripline.

* * * * *